United States Patent [19]

Anagnostopoulos

[11] Patent Number: 5,014,533

[45] Date of Patent: May 14, 1991

[54] WIRE PROCESSING MACHINE

[75] Inventor: Panagiotis A. Anagnostopoulos, Athens, Greece

[73] Assignee: Ergon S.A., Athens, Greece

[21] Appl. No.: 562,431

[22] Filed: Aug. 2, 1990

Related U.S. Application Data

[63] Continuation of Ser. No. 182,666, Apr. 18, 1988, abandoned.

[30] Foreign Application Priority Data

Jun. 3, 1987 [GR] Greece ..... 87.0865
Jun. 3, 1987 [GR] Greece ..... 87.0866

[51] Int. Cl.[5] ..... B21D 3/04; B21D 7/24; B21F 11/00

[52] U.S. Cl. ..... 72/131; 72/161; 72/162; 72/164; 72/203; 72/235; 72/294; 72/307; 72/388

[58] Field of Search ..... 72/164, 165, 162, 217-219, 72/294, 203, 131, 245, 248, 307, 388, 387, 235, 161

[56] References Cited

U.S. PATENT DOCUMENTS

| | | | |
|---|---|---|---|
| 2,567,770 | 9/1951 | Heller | 72/164 |
| 3,389,589 | 6/1968 | Siegerist | 72/162 |
| 3,533,257 | 10/1970 | Aldred | 72/162 |
| 3,626,732 | 12/1971 | Krafft | 72/162 |
| 3,680,347 | 8/1972 | Schenck et al. | 72/217 |
| 3,713,317 | 1/1973 | Schenck et al. | 72/217 |
| 3,788,122 | 1/1974 | Ritter et al. | 72/217 |
| 4,248,273 | 2/1981 | Marcello | 72/217 |
| 4,799,373 | 1/1989 | Benton | 72/219 |

FOREIGN PATENT DOCUMENTS

| | | | |
|---|---|---|---|
| 167656 | 2/1951 | Austria | 72/164 |
| 1900016 | 8/1970 | Fed. Rep. of Germany | 72/162 |
| 870596 | 4/1987 | Greece | 72/160 |
| 827211 | 5/1981 | U.S.S.R. | 72/162 |
| 1105254 | 7/1984 | U.S.S.R. | 72/235 |
| 783894 | 10/1957 | United Kingdom | 72/162 |

OTHER PUBLICATIONS

Charles Wick, John Benedict, Raymond Veilleux, "Tool and Manufacturing Engineer's Handbook", (vol. II, Forming 4th ed.), SME Publications, Dearborn, Mich., 11 pages.

*Primary Examiner*—Daniel C. Crane
*Attorney, Agent, or Firm*—Cushman, Darby & Cushman

[57] ABSTRACT

An apparatus for processing wire or rods includes a plurality of driven fixed rollers for feeding the wire or rod through the apparatus, each fixed roller having an axis of rotation normal to the central access of the wire rod. A plurality of adjustable rollers is provided for engaging the wire rod and imparting a plastic deformation thereto. Each adjustable roller has an axis of rotation and the adjustable rollers are offset from the fixed rollers. A device is provided for moving the adjustable rollers from a position out of engagement with the wire rod to a position engaging the wire rod. A device is also provided for independently adjusting the adjustable rollers so that the planes defined by the axis of rotation of the adjustable rollers are set at an adjustable angle to the central axis of the wire rod so that a desired torsion can be applied to the wire rod. A wire bending device is also provided for bending the wire or rod, and a cutter is provided for cutting the wire or rod.

25 Claims, 3 Drawing Sheets

WIRE PROCESSING MACHINE

This is a continuation of application Ser. No. 07/182,666, filed on Apr. 18, 1988, which was abandoned upon the filing hereof.

FIELD OF THE INVENTION

The invention refers to a machine for processing circular section wire, including straightening, two directional bending and cutting.

BACKGROUND OF THE INVENTION

Conventional machines for wire straightening, bending and cutting are distinguished from the present invention for several reasons. For example, wire pulling in conventional machines is achieved through two roller pairs, placed exactly across the wire, which press the wire in between, forcing it to pass through straightening rollers, located ahead of the pulling rollers. This results in a radial deformation of the wire. To prevent deformation, different rollers with respective grooves should be used for each wire diameter. However, this results in a loss of time and money during adjustment to new wire diameters.

Further, conventional machines use three pins for two directional bending. Two of the pins position the wire and are fixed. The third pin is a bending pin which bends the wire around one or the other fixed pin for left or right bends respectively. This is a disadvantage because when the bending pin is on the right, and a left bend is required, the pin has to pass under the wire to go left. This makes conventional machines complicated.

Still further, in conventional machines cutting is accomplished by a cutter located either ahead of the bending head, causing the wire to move backwards to be cut thereby making the machine slow and complicated, or after the bending head, where a movable cutter has to approach for cutting. This design leads to inefficiency and higher costs for conventional machines.

SUMMARY OF THE INVENTION

The present invention which solves the above described problems in the conventional machines, includes: a device for forcing torsion and pulling and straightening a wire; a device for bending the wire in two directions with an adjustable curvature radius; and a mounted cutter, which follows the wire while bending and which can cut the wire in any position.

In the present invention there is no need for the two roller pairs of the conventional machines. Instead, the wire is pulled through the machine by lower mechanically driven straightening rollers. The pulling force is thus distributed to several rollers thereby avoiding surface deformation of the wire, and thereby allowing straightening to become easier. Moreover, wire feeding is easier, since the straightening rollers pull the wire as soon as it is put in contact with them. Upper straightening rollers are not driven directly, and they are provided to force a slight wire torsion, as will be more fully explained below.

The advantage of the bending system used in the present invention is that only two pins are used for two directional bending. In each bending operation, one pin acts as the pin around which the wire is bent and the other pin acts as the bending pin. For counter bends, the functions of both pins alternate.

The bender mounted fixed cutter enables cutting of the wire while the bender is being rotated or directly after the bend has been made without leaving a straight portion of wire, should it be desired to avoid such a straight portion of wire.

The above mentioned functions and apparatus will be explained in detail using FIGS. 1, 2 and 3.

DETAILED DESCRIPTION OF THE INVENTION

Figure 1:
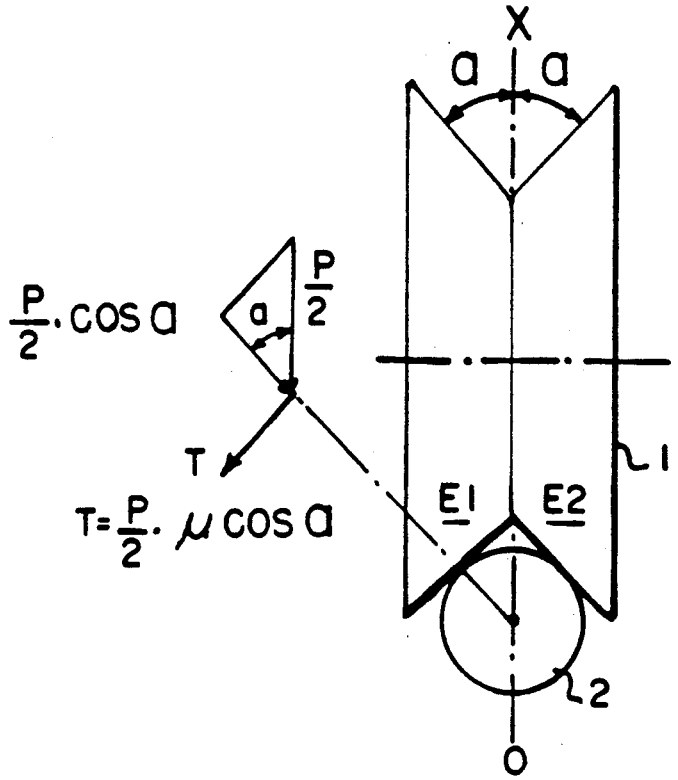
FIGS. 1 and 1A respectively show profile and plan views of a rod straightening system using rollers.
Figure 1A:
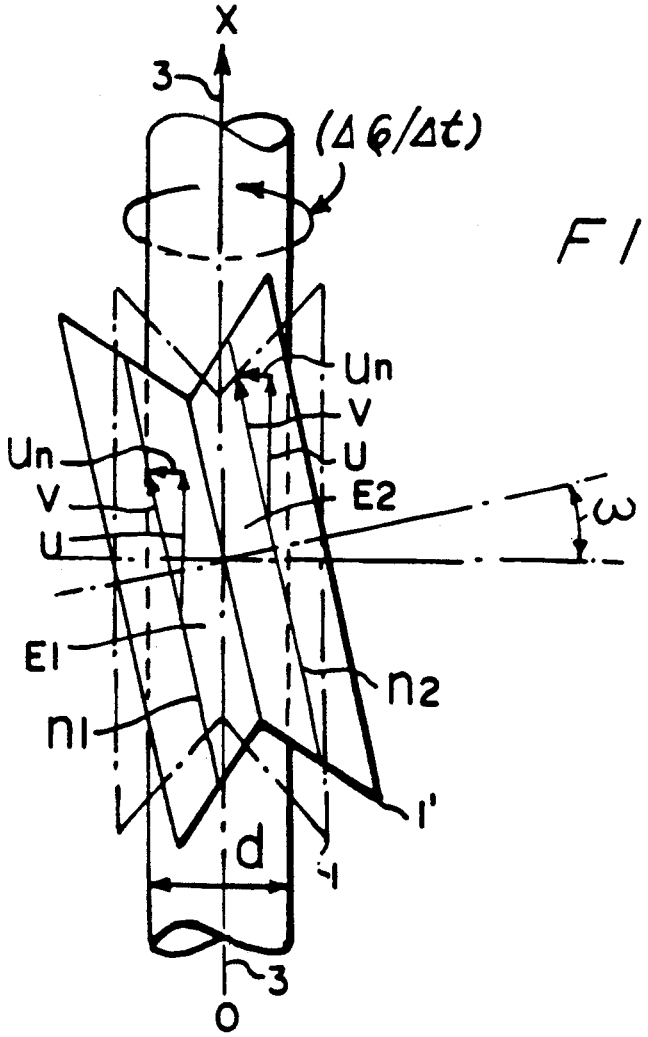

FIGS. 1 and 1A shows roller 1 of a rod straightening system using rollers, with straightened rod 2 exactly below it. This diagram for examining torsion applied to the rod applies to all conventional static circular section metal rod straightening systems.

If roller 1 is rotated by an angle $\omega$ to roller position 1', around an axis perpendicular to rod axis ox and passing through the roller centerpoint, torsion on the straightened and pulled rod 2 is achieved, as can be proved theoretically and practically. The rotation of roller 1 to roller position 1', thus deviates from the position of a conventional roller lying in a plane passing through OX.

The important result achieved, through this rotation of roller 1, on the controlled rod torsion is one of the key features of the present invention. This controlled rod torsion enables the forming of perfect 2-D shapes and complicated 3-D shapes on automatic rod bending machines.

If roller 1 is rotated by an angle $\omega$, counterclockwise in FIGS. 1 and 1A, it takes position 1' and contacts rod 2 at points El and E2. Points E1 and E2 are acted upon both by velocity $\overline{u}$of pulled rod 2 and by rotational speed $\overline{V}$of rotating roller 1.

The direction of $\overline{V}$is constant and tangential to circles $\pi 1$ and $\pi 2$ of roller 1. If there is no slip between the contacting surfaces, points El and E2 (belonging to the rod) follow ($\overline{V}$). This is possible only if there is rod torsion, giving a rotational speed of the rod contact points, as indicated in FIGS. 1 and 1A.

The vector equation for this arrangement is:

$$\overline{V}=\overline{u}+\overline{u}_{\pi} \tag{a}$$

For small values of angle $\omega$:

$$V=u/\cos\omega=u \tag{b}$$

$$U_{\pi} = u\tan\omega = (u)(\omega)(\mathrm{RAD}) = \frac{\pi}{180}(u)(\omega)(^{\circ}) \tag{c}$$

The rod centerpoint 0 is approximately fixed. If $(\Delta\phi/\Delta t)$ is the torsion angle of the rod in one second, and (d) the rod diameter, the following equation can be derived.

$$U_{\pi} = (\Delta\phi/\Delta t)\,(d/2) = \frac{n}{180}(u)(\omega)(^{\circ}) \text{ or} \tag{d}$$

-continued $$(\Delta\phi/\Delta t)\ (^\circ/\text{sec}) = 34.9\ \frac{u(m/s)(\omega)(^\circ)}{d(\text{mm})}$$

This means that a counterclockwise angle of roller 1 results in a clockwise torsion of the pulled rod 2 (pulled in the direction of X) a clockwise angle results in a counterclockwise torsion.

The resulting torsion torque Mt by each rotating roller is given as follows.

$$Mt=(\text{Friction})\ d/2=(T)(d)=0.5(P)(\mu)\cos(a)(d)$$

where

P is the roller pressing force;

T is the friction force;

a is the half roller angle; and $\mu$ is the friction factor.

For (n) rollers, the total torsion torque is given as follows.

$$Mto=(0.5)(n)(P)(\mu)\cos(a)(d) \qquad (e)$$

The required power N for the torsion is given as follows.

$$N=(Mto)(\Delta\phi/\Delta t)(kpm)(rad/sec) \text{ or } 175\ HP$$

Figure 2:
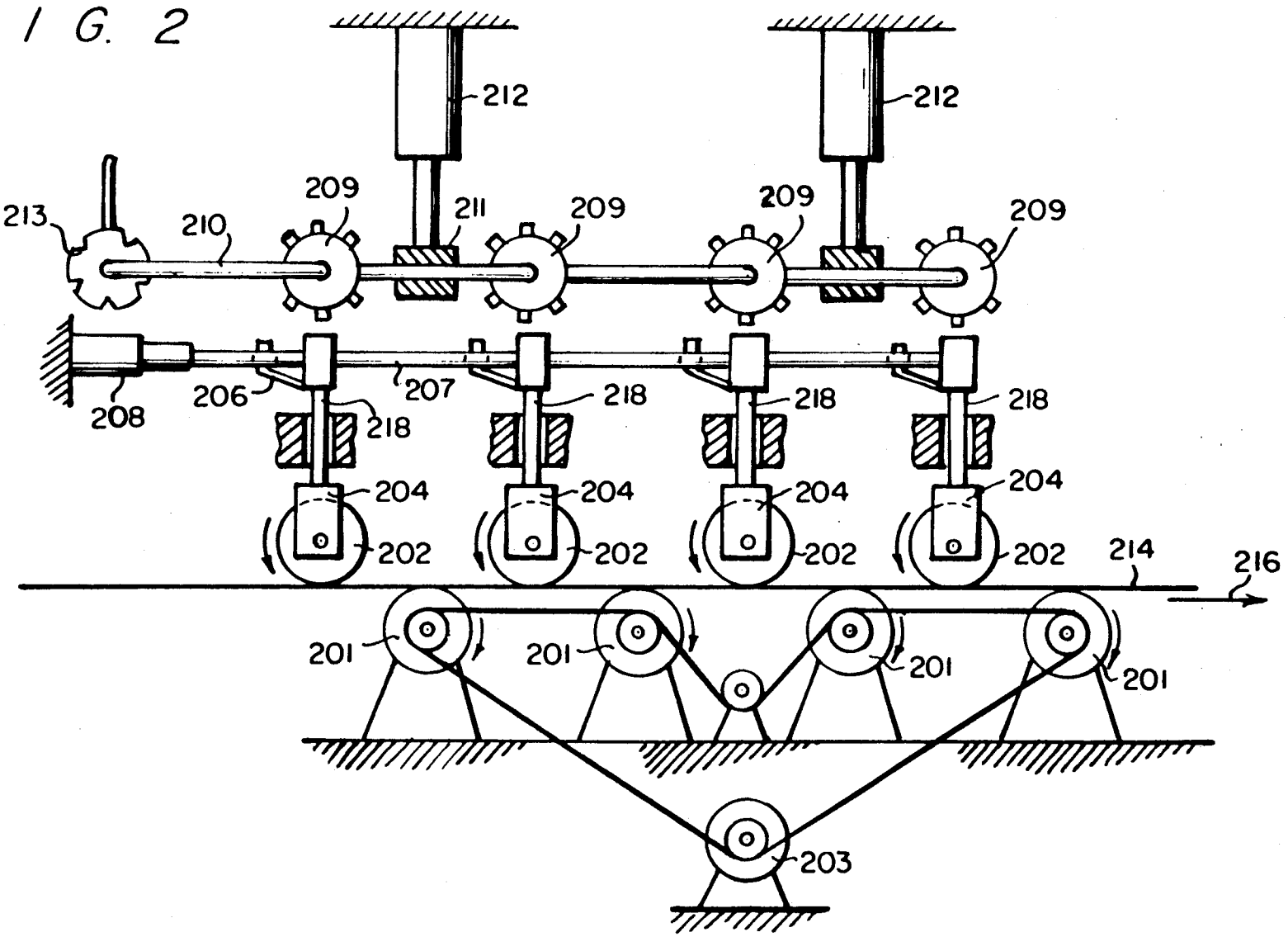
FIG. 2 is a sectional view of the wire processing machine of the present invention.

FIG. 2 shows a sectional view of the wire processing machine made in accordance with the present invention. Wire transportation from a pay-off station to the machine is usually described as pulling or forwarding of the wire. There may be any number of nonadjustable rollers 201 (with one or more grooves) as well as of adjustable rollers 202 (with one or more grooves). The number of nonadjustable and adjustable rollers can be equal to each other or can differ by one. The distances between nonadjustable rollers 201 and the distances between adjustable rollers 202 can be equal to each other or can differ from each other. The rollers are preferably grooved but can also be ungrooved.

In operating the machine, metal wire 214 is put between rollers 201 and 202. Metal wire 214 is trapped between nonadjustable rollers 201 and adjustable rollers 202 by moving adjustable rollers 202 towards nonadjustable rollers 201. This is done by pistons 212, which push housing 211 and shaft 210, thereby pushing adjustable discs 209.

The number of discs 209 is equal to the number of adjustable rollers 202. Each disc 209 includes a plurality of adjustable pins 215, placed if possible, on the corners of a regular polygon. The length of each pin 215 can be adjusted by a bolt (not shown). The pins 215 are grouped. Each group has a pin number, and includes a similar pin on each one of the discs 209. The pins of every group, one pin 215 to each disc 209, are similarly positioned relative to shaft 210. The discs 209 are actually normal to shaft 210, but for visualization purposes are drawn turned by 90°. Disc shaft positioner 213 controls which pin group will press adjustable roller supports 204 when shaft 210 is rotated.

Each pin group pushes adjustable roller supports 204, thereby pressing rollers 202 and forcing them into the spaces between nonadjustable rollers 201. Wire 214 is trapped this way and is forced to form a curved line between adjustable rollers 201 and nonadjustable rollers 202. As nonadjustable rollers 201 are driven by motor 203 in a rotation direction 217, wire 214 moves towards pulling direction 216. Any type of motor may be used, but a hydraulic one gives best performance. The rollers can be driven by more than one motor, each motor driving one group of rollers 201. In FIG. 2, only one motor 203 is presented schematically and is shown linked through a chain to all nonadjustable rollers 201. If rotation direction 217 of motor 203 is reversed, wire pulling direction 216 also reverses.

For each rod diameter, e.g., 6, 8, 10, 12, 14 or 16 mm, the lengths of a group of pins 215 is preset to give the best pulling and straightening, as will be described below. By rotating simultaneously all of discs 209 through positioner 213 and shaft 210, the feeder is adjusted very quickly and precisely for each wire diameter. The end of the approach between rollers 201 and 202 is determined by pistons 212.

The final position of adjustable rollers 202 with respect to nonadjustable rollers 201 guarantees a plastic deformation of wire 214 at the contact points between wire 214 and rollers 201 and 202. This deformation differs from roller to roller depending on the setting of the respective pin 215. The elastic comeback of wire 214 after its plastic deformation is exactly sufficient to give wire 214 a straight form on one axis. For full straightening of wire 214, a second mechanism is required, similar to the one described above. Its rollers should be positioned on an axis normal to the first mechanism, and should be located directly after the first one at a distance which will not cause undesirable plastic deformation of the processed wire.

Adjustable roller supports 204 may be rotated around axis of rotation 218, using levers 206 and a common transmission bar 207, driven by bidirectional piston 208. Each roller support 204 can be rotated in a housing 205 around axis 218 in either direction in relation to the direction of wire pulling by a small angle. Due to the friction between rollers 202 and wire 214, rotation of rollers 202 around axis 218 results in a torsional movement of pulled wire 214. If piston 208 is left unpowered, adjustable rollers 202 stabilize in the direction of the wire pulling as a result of the roller grooves.

Figure 3:
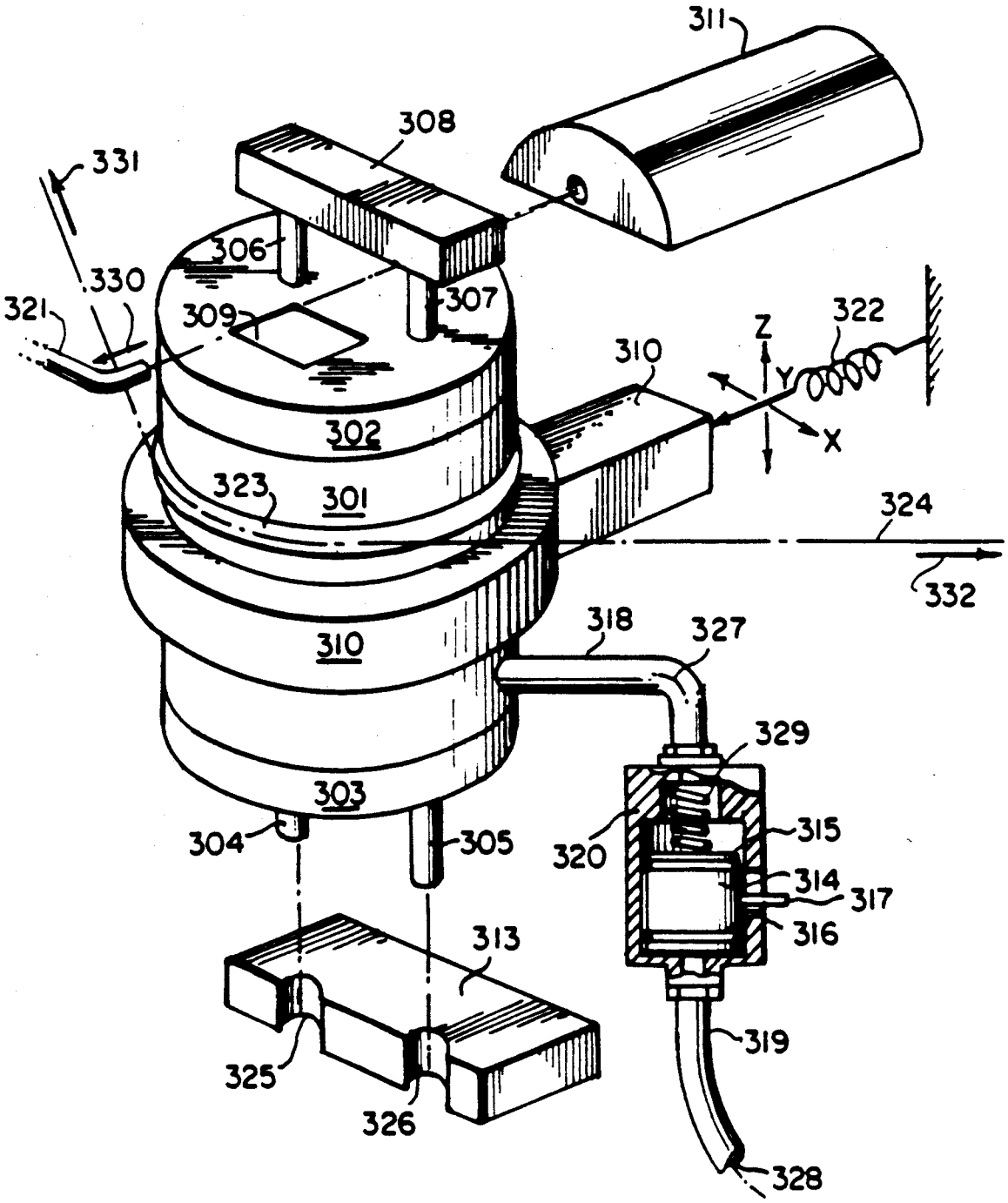
FIG. 3 is a perspective view of the bending and cutting apparatus of the present invention.

FIG. 3 shows a bending and cutting apparatus in accordance with the present invention. Housing 310 is disposed such that it remains parallel to plane XY. Inside housing 310, rotating body 301 of a bender system rotates freely, driven by a motor (not shown), through a chain gear 323 and a chain 324. Chain 324 can be driven in both directions 331 and 332. A moving cutter (not shown) passes through square opening 309 and is driven by a piston (not shown). The rotating body 301 includes at one end an interchangeable upper part 302 and at the other end an interchangeable lower part 303. Parts 302 and 303 are fastened to the body 301 by means of belts (not shown).

The interchangeable upper part 302 includes square opening 309 through which passes the moving cutter (not shown), upper left pin 306 and upper right pin 307 of fixed cutter 308. Pins 306 and 307 locate fixed cutter 308 at a certain distance from an upper surface of upper part 302 and are also used to provide bending of wire 321 passing between them in direction 330.

Interchangeable lower part 303 includes lower left pin 305 and lower right pin 304. Return spring 322 keeps housing 310 in such a position that at least one of pins 304 or 305 is placed inside grooves 325 or 326 of plate 313, respectively. The distance between the centerpoints of semicircular grooves 325 and 326 is equal to the distance between the centerpoints of upper pins 306 and 307. Pins 304 and 305, as well as pins 306 and 307 can be provided with outer rings (not shown) to prevent wear. The outer diameter of pins 304 and 305 is equal to the diameter of grooves 325 and 326, respectively. The outer diameter of pins 306 and 307 is equal to an inner radius that is desired to be formed on wire 321. Wire 321 passes through pins 306 and 307 after passing through fixed wire guide 311.

If the motor drives chain 324 in direction 331, body 301 will rotate inside housing 310 and pin 304 will be rotated in groove 325 while pin 305 will be rotated away from groove 326. Body 301 will rotate inside housing 310 and the housing 310 will move respectively inside the XY plane. Pin 306 will be rotated around the same axis as is pin 304 and pin 307 will move, pressing wire 321 and bending it as shown. The opposite happens when chain 324 is driven in direction 332.

Upper part 302 along with pins 306 and 307 and fixed cutter 308, and lower part 303 along with pins 304 and 305 and plate 313 with its grooves 325 and 326, build a series of interchangeable parts. Interchanging these parts allows bending of various sizes of metal rods with various curvature radii. Different curvatures of radii can be formed by different diameters of pins 306 and 307. Cutting is achieved by pushing moving cutter (not shown) through opening 309 to approach fixed cutter 308, as is usual in cutters shearing metal wire. When the wire is cut, by the upwardly moving cutter through opening 309, it is launched away from the table's surface where it rests. The moving cutter is driven by a hydraulic piston (not shown), located in the rotating body 301. The piston is driven only in the cutting direction by high pressure oil and is drawn back by a spring (not shown). The positioning of the moving cutter in this manner is of great importance, because it decreases the moving cutter stroke in small diameter rods and because it facilitates the next command to the bending head directly after cutting.

A flexible transmission system must be used to transmit power from a fixed point to the moving cutter. Cylinder 320 of transmission piston 314 is inserted between flexible high pressure oil pipe 319 running from a hydraulic pump (not shown) and flexible high pressure oil pipe 318 running to the cutter piston. Piston 314 reciprocates freely inside cylinder 320, supported against the input of the higher pressure oil by coil 329. Piston 314 is provided with two seals 315 and 316.

Position marker 317 supplies information about the position of transmission piston 314 to the exterior of cylinder 320. Both interior spaces 327 and 328 of flexible pipes 318 and 319, respectively, are filled with oil after removing air. In this way oil pressure from space 328 is transmitted through piston 314 to the oil of space 327. Piston 314 movement can be followed by position marker 317. Given that oil is not compressible and piping 318 is inelastic, piston 314 movement corresponds directly to the moving cutter piston movement, thus allowing full monitoring of the latter.

Although the present invention has been described with respect to specific embodiments, it should be obvious that there are numerous variations within the scope of the present invention. Thus, the present invention is intended to cover not only the described embodiments, but also those variations falling within the scope of the appended claims.

I claim security of my invention, the machine for processing of circular section wire, consisting of straightening system (FIG. 2), pulling rollers (FIG. 2), upper rollers (FIG. 2) rotating system for upper rollers (FIG. 2), bending head for two direction bending (FIG. 3), flying cutter (FIGS. 3, 9), motor, chain (FIGS. 3, 24), plate (FIGS. 3, 13) and pins (FIGS. 3, 4 and 5) and having following features:

1. An apparatus for processing wire or rods, comprising:

a. a plurality of fixed driven rollers having working surfaces for engaging and for feeding wire or a rod in a feed direction, each fixed driven roller having an axis of rotation, said fixed driven rollers defining a first plane normal to their respective axes with a central axis of the wire or rod being processed being parallel with the first plane;

b. drive means for driving said plurality of fixed driven rollers;

c. a plurality of adjustable non-driven rollers having working surfaces for engaging the wire or rod and imparting a plastic deformation thereto, each adjustable non-driven roller having an axis of rotation, said plurality of adjustable non-driven rollers defining a plurality of second planes normal to their respective axes of rotation;

d. actuating means for moving said plurality of adjustable non-driven rollers from a first position out of engagement with the wire or rod to a second position engaging the wire or rod, and e. means for independently adjusting said plurality of adjustable non-driven rollers so that the second planes defined by said plurality of adjustable non-driven rollers define desired angles with said first plane defined by said plurality of fixed driven rollers, whereby, when said plurality of adjustable non-driven rollers engage said wire or rod, a desired torsion is applied to the wire or rod.

2. An apparatus according to claim 1, further comprising second means for independently adjusting said plurality of adjustable non-driven rollers, wherein said second means controls the degree of said plastic deformation by adjusting the second position of said plurality of adjustable non-driven rollers.

3. An apparatus according to claim 2, wherein said actuating means further comprises:

a. a piston having a cylinder and a shaft connected with the cylinder, said piston having a stroke with first and second ends;

b. displaceable support means for supporting said plurality of adjustable non-driven rollers; and c. cam means, operably connected to the shaft of said piston, for engaging said displaceable support means of said plurality of adjustable non-driven rollers, wherein, when said piston is at the first end of its stroke said cam means is out of engagement with said displaceable support means and said actuating means is in the first position, and when said piston is at the second end of its stroke, said cam means engages said displaceable support means and said actuating means is in the second position.

4. An apparatus according to claim 3, wherein said cam means further comprises a cam shaft, a plurality of cam disks disposed on the cam shaft, and a plurality of adjustable pins disposed on each cam disk for engaging said displaceable support means and adjusting the second position of each one of said plurality of adjustable non-driven rollers.

5. An apparatus according to claim 1, further comprising means for cutting the wire or rod subsequent to the wire or rod being fed past said plurality of fixed driven rollers in the feed direction.

6. An apparatus according to claim 5, further comprising means for bending the wire or rod prior to it being cut.

7. An apparatus according to claim 6, wherein said means for bending the wire or rod comprises:

a. a housing disposed after said plurality of fixed driven rollers in the feed direction;

b. a rotating body rotatably disposed in said housing, and having a top and a bottom;

c. means for rotating said rotating body;

d. first and second bending pins disposed in the top of said rotating body for bending the wire or rod; and e. first and second pivot pins disposed in the bottom of said rotating body for providing pivot points for said housing, each of said first and second pivot pins being disposed substantially parallel to a corresponding bending pin, so that when said rotating body rotates about an axis parallel to one of said first and second bending pins the other of said first and second bending pins engages the wire or rod to bend the wire or rod.

8. An apparatus according to claim 7, wherein said cutting means comprises: a movable cutter connected to said rotating body and disposed past said first and second bending pins in the feed direction and substantially parallel to said first and second bending pins; and a fixed cutter connected to said rotating body and disposed parallel to said first and second bending pins, said movable cutter being movable against said fixed cutter for cutting the wire or rod.

9. An apparatus according to claim 8, said movable cutter being disposed so as to cut the wire or rod at any desired portion of a bend in the wire or rod formed by one of said first and second bending pins.

10. An apparatus according to claim 8, further comprising means for actuating said cutter comprising hydraulic supply means for transmitting hydraulic pressure to said movable cutter for actuating said cutter, a transmission piston disposed between the supply means and the movable cutter, wherein movement of said transmission piston corresponds to movement of said cutter.

11. An apparatus for processing wire or rods, comprising:

a. a plurality of fixed rollers for feeding wire or a rod in a feed direction, each fixed roller having an axis of rotation, said fixed rollers defining a first plane normal their respective axes and containing a central axis of the wire or rod to be processed;

b. drive means for driving said fixed rollers;

c. a plurality of adjustable rollers for engaging the wire or rod and imparting a plastic deformation thereto, each adjustable roller having an axis or rotation, said adjustable rollers defining a plurality of second planes normal to their respective axes of rotation;

d. actuating means for moving said adjustable rollers from a first position out of engagement with the wire or rod to a second position engaging the wire or rod, said actuating means including:

1. a piston having a cylinder and a shaft connected with the cylinder, said piston having a stroke with first and second ends;

2. displaceable support means for supporting said adjustable rollers; and 3. cam means, operably connected to the shaft of the piston, for engaging the displaceable support means of the adjustable rollers, wherein, when said piston is at the first end of its stroke the cam means are out of engagement with the displaceable support means and said actuating means is in the first position, and when the piston is at the second end of its stroke, the cam means engage the displaceable support means of the adjustable rollers and said actuating means is in the second position; and e. first means for independently adjusting said adjustable rollers so that the second planes defined by said adjustable rollers define desired angles with said first plane defined by the fixed rollers, whereby, when said adjustable rollers engage said wire or rod, a desired torsion is applied to the wire or rod.

12. An apparatus according to claim 11, further comprising second means for independently adjusting the adjustable rollers, wherein the second means control the degree of said plastic deformation by adjusting said second engaging position of the adjustable rollers.

13. An apparatus according to claim 11, wherein said cam means further comprise a cam shaft, a plurality of cam disks disposed on the cam shaft, and a plurality of adjustable pins disposed on each cam disk for engaging the displaceable support for the adjustable rollers and adjusting the second position of each adjustable roller.

14. An apparatus according to claim 11, further comprising means for cutting the wire or rod after the wire or rod is fed past the stationary rollers in the feed direction.

15. An apparatus according to claim 14, further comprising means for bending the wire or rod before it is cut.

16. An apparatus according to claim 15, wherein said means for bending the wire or rod comprises:

a housing disposed after the stationary rollers in the feed direction;

a rotating body, rotatingly disposed in the housing, and having a top and a bottom;

means for rotating the body;

first and second bending pins disposed in the top of the body for bending the wire or rod; and first and second pivot pins disposed in the bottom the body for providing pivot points for said housing, each pivot pin being disposed substantially parallel to a corresponding bending pin, wherein, when the housing is rotated, the housing rotates about an axis parallel to one of first and second bending pins the other of said bending pins engages the wire or rod to bend the wire or rod.

17. An apparatus according to claim 16, wherein said cutting means comprises: a movable cutter connected to said rotating body and disposed past said bending pins in the feed direction and substantially parallel to the bending pins; and a fixed cutter connected to said rotating body and disposed parallel to the bending pins, wherein the movable cutter is movable against said fixed cutter for shearing the wire or rod.

18. An apparatus according to claim 17, wherein said movable cutter is disposed so as to cut the wire or rod at any desired portion of a bend in the wire or rod formed by one of the two bending pins.

19. An apparatus according to claim 17, further comprising means for actuating said cutter comprising hydraulic supply means for transmitting hydraulic pressure to said movable cutter for actuating said cutter, a transmission piston disposed between the supply means and the movable cutter, wherein movement of said transmission piston corresponds to movement of said cutter.

20. An apparatus for processing wire or rods, comprising:

a. a plurality of fixed rollers for feeding wire or a rod in a feed direction, each fixed roller having an axis of rotation, said fixed rollers defining a first plane normal their respective axes and containing a central axis of the wire or rod to be processed;

b. drive means for driving said fixed rollers;

c. a plurality of adjustable rollers for engaging the wire or rod and imparting a plastic deformation thereto, each adjustable roller having an axis or rotation, said adjustable rollers defining a plurality of second planes normal to their respective axes of rotation;

d. first actuating means for moving said adjustable rollers from a first position out of engagement with the wire or rod to a second position engaging the wire or rod;

e. first means for independently adjusting said adjustable rollers so that the second planes defined by said adjustable rollers define desired angles with said first plane defined by the fixed rollers, whereby, when said adjustable rollers engage said wire or rod, a desired torsion is applied to the wire or rod;

means for bending the wire or rod before it is cut, said means for bending the wire or rod including:

1. a housing disposed after the stationary rollers in the feed direction;
2. a rotating body, rotatingly disposed in the housing, and having a top and a bottom;
3. means for rotating the body;
4. first and second bending pins disposed in the top of the body for bending the wire or rod; and
5. first and second pivot pins disposed in the bottom of the body for providing pivot points for said housing, each pivot pin being disposed substantially parallel to a corresponding bending pin, wherein, when the housing is rotated, the housing rotates about an axis parallel to one of first and second bending pins the other of said bending pins engages the wire or rod to bend the wire or rod; and means for cutting the wire or rod after the wire or rod is fed past the stationary rollers in the feed direction, said cutting means including a movable cutter connected to said rotating body and disposed past said bending pins in the feed direction and substantially parallel to the bending pins, and a fixed cutter connected to said rotating body and disposed parallel to the bending pins, wherein the movable cutter is movable against the fixed cutter for shearing the wire or rod.

21. An apparatus according to claim 20, further comprising second means for independently adjusting the adjustable rollers, wherein the second means control the degree of said plastic deformation by adjusting said second engaging position of the adjustable rollers.

22. An apparatus according to claim 21, wherein said first actuating means further comprises:

a piston having a cylinder and a shaft connected with the cylinder, said piston having a stroke with first and second ends;

b. displaceable support means for supporting said adjustable rollers; and c. cam means, operably connected to the shaft of the piston, for engaging the displaceable support means of the adjustable rollers, wherein, when said piston is at the first end of its stroke the cam means are out of engagement with the displaceable support means and said actuating means is in the first position, and, when the piston is at the second end of its stroke, the cam means engage the displaceable support means of the adjustable rollers and said actuating means is in the second position.

23. An apparatus according to claim 22, wherein said cam means further comprise a cam shaft, a plurality of cam disks disposed on the cam shaft, and a plurality of adjustable pins disposed on each cam disk for engaging the displaceable support for the adjustable rollers and adjusting the second position of each adjustable roller.

24. An apparatus according to claim 20, wherein said movable cutter is disposed so as to cut the wire or rod at any desired portion of a bend in the rod formed by one of the two bending pins.

25. An apparatus according to claim 20, further comprising means for actuating said cutter comprising hydraulic supply means for transmitting hydraulic pressure to said movable cutter for actuating said cutter, a transmission piston disposed between the supply means and the movable cutter, wherein movement of said transmission piston corresponds to movement of said cutter.

* * * * *